US005417591A

United States Patent [19]

Demmler

[11] Patent Number: 5,417,591

[45] Date of Patent: May 23, 1995

[54] CONNECTION DEVICE FOR AN ELECTRICAL ARRANGEMENT SHIELDED BY AN ELECTRICALLY CONDUCTIVE WALL OF A HOUSING

[75] Inventor: Holger Demmler, Bundesrepublik Deutschland, Germany

[73] Assignee: Fichtel & Sachs AG, Schweinfurt, Germany

[21] Appl. No.: 161,784

[22] Filed: Dec. 2, 1993

[30] Foreign Application Priority Data

Dec. 4, 1992 [DE] Germany ..... 42 40 836.9
Nov. 20, 1993 [DE] Germany ..... 43 39 653.4

[51] Int. Cl.[6] ..... H01R 13/66
[52] U.S. Cl. ..... 439/620
[58] Field of Search ..... 439/95, 98, 620

[56] References Cited

U.S. PATENT DOCUMENTS 3,579,155 5/1971 Tuchto .
3,854,107 12/1974 Tuchto .
4,519,665 5/1985 Althouse .
4,929,196 5/1990 Ponn .
5,057,041 10/1991 Yu .
5,152,699 10/1992 Pfeifer ..... 439/620
5,167,536 12/1992 Wang .
5,219,305 6/1993 Kawaguchi et al. ..... 439/620

FOREIGN PATENT DOCUMENTS 0487984A 6/1992 European Pat. Off. .
1489853 4/1976 United Kingdom .
217921A 2/1987 United Kingdom .

*Primary Examiner*—Eugene F. Desmond
*Attorney, Agent, or Firm*—Brumbaugh, Graves, Donohue & Raymond

[57] ABSTRACT

A connection device of an electrical arrangement (8) shielded by an electrically conductive wall (2) of a housing includes a contact carrier member (4, 5, 6) composed of plastic material, and in particular embodied as a shaped plastic element, that is insertable into an opening (3) of the wall (2), and a plurality of contact elements (7), embodied in particular as contact pins, mounted on the contact-carrier member (4, 5, 6) and piercing such member (4, 5, 6) transversely of the wall (2). The contact carrier member (4, 5, 6) includes a shielding plate (9) electrically connectable to the wall (2) and pierced by the contact elements (7). A lead-through capacitor (11) is associated separately with each contact element (7) and is electrically connected to the shielding plate (9) and is penetrated by the associated contact element (7).

11 Claims, 2 Drawing Sheets

CONNECTION DEVICE FOR AN ELECTRICAL ARRANGEMENT SHIELDED BY AN ELECTRICALLY CONDUCTIVE WALL OF A HOUSING

BACKGROUND OF THE INVENTION

The present invention relates to a connection device for an electrical arrangement shielded by an electrically conductive wall of a housing, including a plastic contact-carrier member that is insertable into an opening of the wall and a plurality of contact elements mounted on the contact-carrier member and piercing the contact carrier member transversely of the wall.

Connection devices of this type are used in many fields, including motor vehicles. Particularly when used in the motor vehicles, it is important that such connection devices not only be mechanically tight in order to avert soiling, but also that they assure adequate electromagnetic shielding of the electrical arrangement, with a view to freedom from electrical interference. These requirements are not optimally met by prior art connection devices. It is therefore an object of the present invention to provide a connection device of the type referred to that assures both complete mechanical sealing and complete electromagnetic shielding.

SUMMARY OF THE INVENTION

According to the invention, this and other objects are attained by providing a plastic contact-carrier member which includes a shielding plate electrically connectable to the housing wall and pierced by the contact elements, each contact element having separately associated therewith a lead-through capacitor which is electrically connected to the shielding plate and which is penetrated by the associated contact element.

By disposing the shielding plate, connected to the lead-through capacitors, on the plastic contact carrier member, the electrical arrangement located in the housing can be both mechanically sealed off and electromagnetically shielded in the manner of a Faraday cage. Hence shielded electronic components can be connected in a manner protected against interference, particularly in a motor vehicle, to units disposed outside the shielding.

The connection device of the invention may be made up of simple, individual component parts by inserting the lead-through capacitors into openings of the shielding plate and joining them at their outer contours to the shielding plate, e.g. by soldering. It is advantageous if the contour of the openings is substantially identical to the outer contour of the lead-through capacitors.

For increased mechanical stability, at least some of the lead-through capacitors are preferably disposed close together, i.e., side by side, and joined directly to one another, e.g. by soldering, along their outer circumferences.

Both stable retention of the contact elements and favorable shielding properties are achieved in accordance with the invention by employing lead-through capacitors having an annular-cylindrical shape in cross section and joining their outer circumferences to the shielding plate and their inner circumferences to the contact elements, both preferably by soldered connections. The lead-through capacitors may, however, also readily have a rectangular or square cross section. The soldering operation not only produces the electrical connections between the components but also increases the mechanical strength of the connection device.

For ease of manufacture and to save material, the shielding plate is preferably substantially flat.

The contact-carrier member can be disposed on the housing wall in a reliably sealed manner by providing a flange on the contact carrier member having regions intended for abutting support against the wall, with the shielding plate being imbedded in the contact carrier member and having one or more electrical contact regions that overlay the regions of the flange intended for support against the wall of the housing. Thus electrical contact between the shielding plate and the electrically conductive housing wall, as well as the desired electrical shielding, is automatically brought about in a reliable fashion when the contact carrier member is mounted on the wall. It is advantageous if the contact region(s) of the shielding plate is offset toward and parallel to the bearing face of the flange, relative to the regions of the shielding plate joined to the lead-through capacitors.

The connection device can be adapted especially well to a plug if it is embodied as a plug receptacle, with the contact carrier member having a bottom with a flange, intended for support against the wall of the housing, and a wall region protruding from the bottom substantially at a right angle, and furthermore if the shielding plate is disposed in the region of the bottom and the contact elements are embodied as contact pins that are parallel to the wall region and penetrate the bottom. As a result, it is possible to provide both the mechanical and the electromagnetic sealing in the plane of the bottom of the plug receptacle.

An especially stable mechanical juncture of an electrical plug to the connection device, which also protects the electrical contacts against soiling, is provided if a wall region of the plug receptacle, together with its bottom, forms a cup, the flange for securing the receptacle to the housing wall protrudes outward from the region of the bottom, and the shielding plate protrudes outward beyond the wall region of the plug receptacle such that the electrical contact regions of the shielding plate rest on surfaces of the flange intended for support against the wall of the housing. Thus by the procedure, known per se, of screwing the plug receptacle to the housing, a stable electrical connection between the shielding plate and the housing wall can be automatically established.

The connection device can be embodied in an especially space-saving way if the wall region has an approximately annular-cylindrical shape, and the flange has an approximately square outer contour whose sides are of a length approximately equal to the outside diameter of the wall region. The shielding plate likewise preferably has a square contour, correspondingly approximately to the contour of the flange, in which the corner regions form the electrical contact regions. As a result, the mating portion of the associated plug may also take an annular-cylindrical configuration and mechanical sealing therebetween can be assured in a simple way by means of one or more O-rings.

It is also conceivable for the wall region and/or the flange to be given some other cross-sectional shape. It may, for instance, be advantageous for the flange to be annular and the contact region of the shielding plate to form an uninterrupted annular region resting on the housing wall. Particularly when space is tight, however, a square shape of the flange is especially suitable, because the plug receptacle occupies little space, and nevertheless the shielding plate can be joined at the four corners of the flange to the electrically conductive housing wall.

If the shielding plate, the lead-through capacitors, and the contact elements are adapted to one another in such a way that they form a preassembled component that can be manipulated independently of the contact-carrier member, then the connection device can be manufactured in a simple way, particularly with a view to embedding this preassembled component in the plastic material of the contact-carrier member. Advantageously, the preassembled component may be tightly extrusion-coated with plastic material. This also affords the opportunity of checking the electrical properties of the connection device in the modular preassembled component before it is embedded in plastic. By using this kind of pre-assembleable module, which is tightly extrusion-coated with the plastic material of the contact-carrier member, perfect mechanical sealing is assured by the plastic extrusion coating. The contact elements, embodied particularly as contact pins, are thus both fixedly disposed and tightly held. If the contact elements are also soldered to the lead-through capacitors, this not only assures a reliable electrical connection but further increases the mechanical strength of the module.

BRIEF DESCRIPTION OF THE DRAWINGS

The invention is described in the accompanying drawings, in terms of an exemplary embodiment, in which.

DESCRIPTION OF AN EXEMPLARY EMBODIMENT

Figure 1:
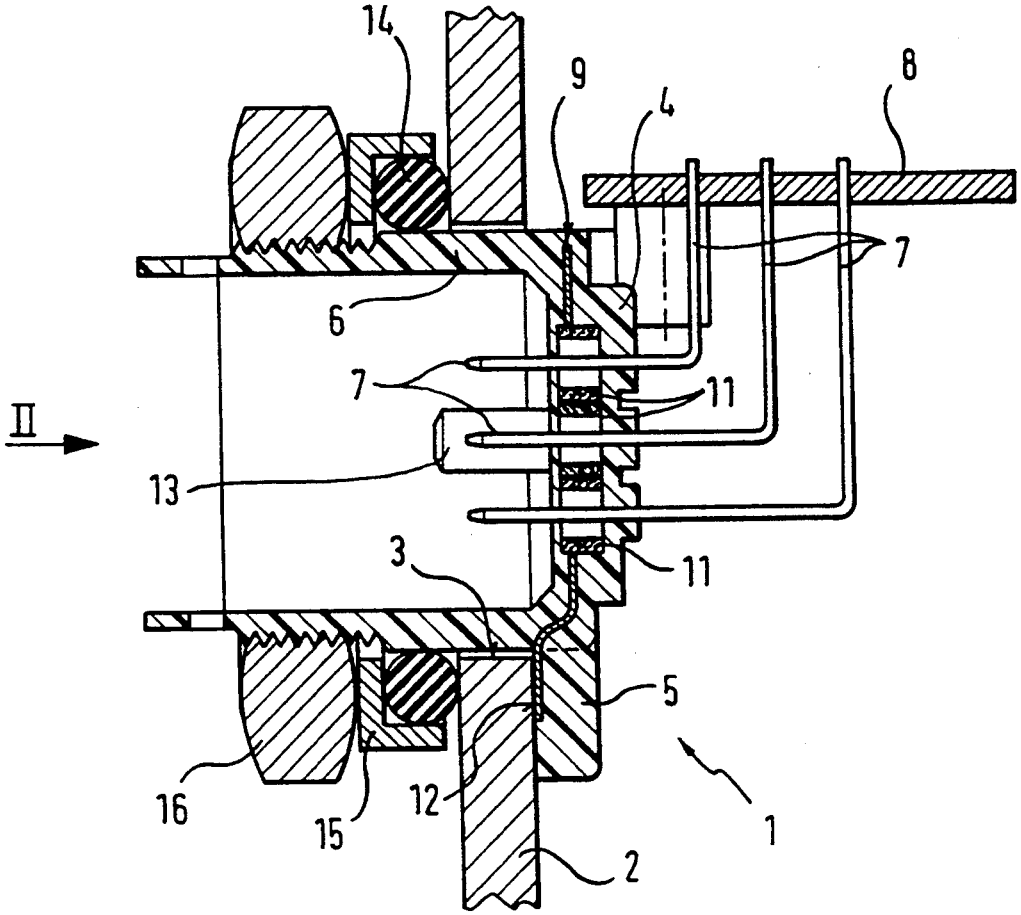
FIG. 1 is a longitudinal section through a connection device according to the invention, taken along the line I—I of FIG. 2.

In FIG. 1, the connection device, embodied as a plug receptacle, is identified by reference numeral 1. The plug receptacle 1 has a bottom 4, which is provided with a radially outwardly extending flange 5. In the installed state of the plug receptacle 1, the bottom 4 and flange 5 extend parallel to an electrically conductive wall 2 of a housing, not shown in further detail. The plug receptacle includes an annular-cylindrical wall region 6 extending approximately perpendicularly from the bottom 4 and through an opening 3 in the housing wall 2. A thread 17 is provided on the outside of the cylindrical wall 6 on side of the housing wall 2 opposite the flange 5, so that a firm, tight connection between the plug receptacle 1 and the housing wall 2 can be established via a nut 16 and, optionally, a compression ring 15 and an O-ring 14. The wall region 6 is preferably annular-cylindrical in cross section, but may also be square or rectangular in shape. The cylindrical shape has the advantage that the mating portion of the plug (not shown) received by the plug receptacle may also be of a generally cylindrical configuration, and inexpensive, functionally reliable sealing can be achieved via an O-ring 14. For purposes of an exact alignment of the plug and the plug receptacle 1, a molded pin 13 is provided to project centrally from the bottom 4 of the plug receptacle 1 and is non-cylindrical in cross section (see FIG. 2).

A shielding plate 9 is embedded in the bottom 4 of the plug receptacle 1 and is provided with lead-through capacitors 11, through which contact pins 7 extend. The contact pins 7 extend substantially perpendicular to the bottom 4 and thus also perpendicular to the shielding plate 9. If desired, the lead-through capacitors 11 may also be accessible from the side of the bottom 4 opposite the wall region 6.

In the region of its outer contour, the shielding plate 9 is formed with one or more contact regions 12 which are offset from and parallel to the plane of the shielding plate in the region of the capacitors 11 and which rest on the bearing surface of the flange 5. In the assembled state of the plug receptacle 1 shown in FIG. 1, the contact regions 12 rest directly on the housing wall 2. Hence, when electrically conductive material is used for the housing wall 2, a direct electrical contact is established between the wall 2 and the shielding plate 9.

The contact pins 7 extend a sufficient distance within the annular-cylindrical wall region 6 of the plug receptacle 1 that they can make a secure electrical connection with the associated plug when it is introduced and retained in the receptacle 1. On the opposite side of the bottom 4, the contact pins 7 are electrically and mechanically connected to a printed wiring board 8 or other electrical component which, for example, may be part of an electrical or electronic control unit.

Figure 2:
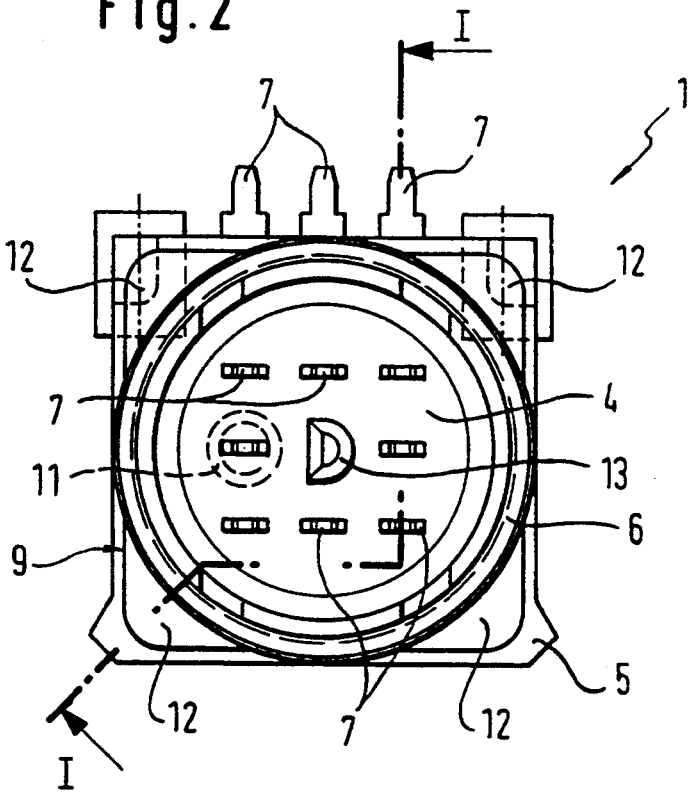
FIG. 2 is a plan view, in the direction of the arrow II of FIG. 1, of the connection device of FIG. 1.

As seen particularly clearly in FIG. 2, the outer contour of the flange 5 is generally square, with a length of each side that corresponds approximately to the outside diameter of the annular-cylindrical wall region 6. In this way, a plug receptacle of particularly space-saving configuration is formed. If more space is available, it is readily possible for the flange 5 to extend concentrically with and spaced apart accordingly from the annular-cylindrical wall region 6. In the view shown, the contact pins 7 and the molded pin 13 can be seen inside the annular-cylindrical wall region 6. In FIG. 2, the plug receptacle 1 is shown as a pre-fabricated component, which has not yet been connected to the printed wiring board 8 as in FIG. 1. The four contact regions 12 of the shielding plate 9, by which electrical connection with the housing wall 2 is made in the installed state, can be seen in the four corner regions of the flange 5, opposite the annular-cylindrical wall region 6.

Figure 3:
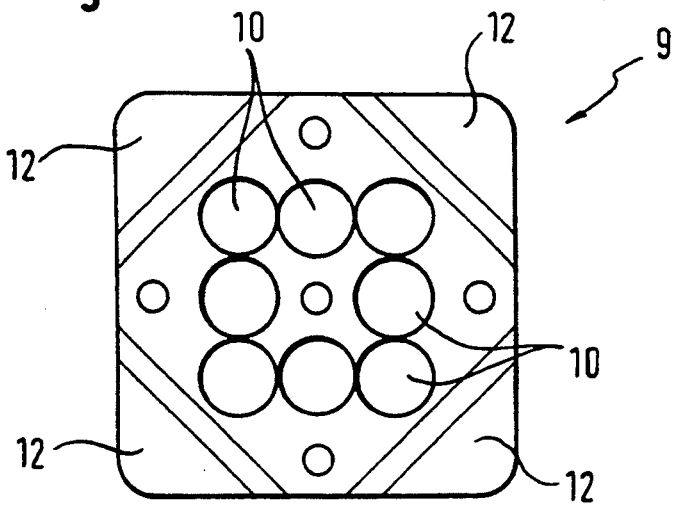
FIG. 3 is a plan view, corresponding to FIG. 2, of the shielding plate of the connecting device of FIG. 1.

FIG. 3 is a plan view of the shielding plate 9. This shows a substantially flat sheet-metal part with a plurality of openings 10, into each of which a lead-through capacitor 11 is to be inserted. The shape of the openings 10 conforms to the outer contour of the lead-through capacitors 11, which in the embodiment shown are generally cylindrical. The lead-through capacitors 11 are inserted into the plate 9 and electrically connected to it, preferably by a soft solder connection. For increased stability, the lead-through capacitors 11 may also be soldered to one another at their adjacent outer circumferential regions, as shown in FIG.3. The same connection is preferably made between the outer contours of contact pins 7 and the inside contour of the lead-through capacitors 11. It is advantageous to carry out this soldering process in one operation. As mentioned, the shielding plate 9 is provided in its peripheral regions, in the present case in the four corners, with contact regions 12, which are offset from and parallel to the plane of the shielding plate 9, so that, upon assembly, the regions 12 are captured between the facing surfaces of the flange 5 and the housing wall 2.

During manufacture of the plug receptacle 1, the shielding plate 9, lead-through capacitors 11 and contact pins 7 are assembled into a module, checked for electrical integrity, and then, in an injection molding machine, extrusion-coated with plastic material to complete the plug receptacle 1. It may also be advantageous, however, not to make the aforementioned soldered connections until after the components have been embedded in the plastic material. After completion, the plug receptacle is mechanically and electrically connected to the printed wiring board 8. The plug receptacle and the unit containing the board 8 can thus be inserted into the housing through an opening 3 in the housing wall 2 and mechanically joined thereto by the nut 16, compression ring 16 and O-ring 14.

This construction assures complete mechanical sealing, as a result of the gap-free extrusion coating of the module with the material of the plug receptacle, and a tight Faraday cage is formed, which assures reliable function of the electrical components, even in a motor vehicle that has electromagnetic interference fields.

Although the invention has been described herein by reference to a particular embodiment thereof, it will be understood that such embodiment is susceptible of modification without departing from the inventive concepts disclosed. All such modifications, therefore, are intended to be included within the spirit and scope of the appended claims.

I claim:

1. In a connection device (1) for an electrical arrangement (8) shielded by an electrically conductive wall (2) of a housing, said device including a contact-carrier member (4, 5, 6) composed of plastic material having a portion that is insertable into an opening (3) of the wall (2), and a plurality of contact elements (7) mounted on the contact-carrier member (4, 5, 6) so as to pierce the contact-carrier member transversely to the wall (2), wherein the improvement comprises:

a shielding plate (9) on said contact-carrier member (4, 5, 6) for electrical connection to the wall (2);

said shielding plate (9) being pierced by the contact elements (7);

a lead-through capacitor (11) associated separately with each contact element (7), each capacitor (11) being electrically connected to the shielding plate (9) and penetrated by the associated contact element (7);

the lead-through capacitors (11) are inserted into respective openings (19) in the shielding plate (9) and are joined at their outer peripheries to the shielding plate (9), and at least a plurality of the lead-through capacitors (11) are disposed in side-by-side relation and are joined directly to one another at their outer peripheries.

2. A connection device in accordance with claim 1, wherein the contour of the openings (10) is substantially identical to the outer contour of the lead-through capacitors (11).

3. A connection device in accordance with claim 1, wherein each lead-through capacitor (11) has an annular-cylindrical cross section and is joined at its outer periphery to the shielding plate (9) and at its inner periphery to the associated contact element (7).

4. A connection device in accordance with claim 1, wherein the shielding plate (9) is substantially flat.

5. A connection device in accordance with claim 1, wherein the shielding plate (9), the lead-through capacitors (11), and the contact elements (7) are secured to one another so as to form a preassembled component that can be manipulated independently of the contact-carrier member (4, 5, 6).

6. A connection device in accordance with claim 5, wherein the preassembled component is extrusion-coated with plastic material to form said contact-carrier member (4, 5, 6).

7. In a connection device (1) for an electrical arrangement (8) shielded by an electrically conductive wall (2) of a housing, said device including a contact-carrier member (4, 5, 6) composed of plastic material having a portion that is insertable into an Opening (3) of the wall (2), and a plurality of contact elements (7) mounted on the contact-carrier member 5, 6) so as to pierce the contact-carrier member transversely to the wall (2), wherein the improvement comprises:

a substantially flat shielding plate (9) on said contact-carrier member (4, 5, 6) for electrical connection to the wall (2);

said shielding plate (9) being pierced by the contact elements (7);

a lead-through capacitor (11) associated separately with each contact element (7), each capacitor (11) being electrically connected to the shielding plate (9) and penetrated by the associated contact element (7);

the contact-carrier member (4, 5, 6) including a flange (5) having a bearing face for engaging the wall (2); and the shielding plate (9) is embedded in the contact-carrier member (4, 5, 6) and includes at least one contact region (12) which overlies the bearing face of the flange (5) so as to make electrical contact with the wall (2) of the housing when the flange (5) engages the wall (2).

8. A connection device in accordance with claim 7, wherein the contact region (12) of the shielding plate (9) is offset towards and parallel to the bearing face of the flange (5) relative to the region of the plate (9) joined to the lead-through capacitors (11).

9. In a plug receptacle (1) for an electrical arrangement (8) shielded by an electrically conductive wall (2) of a housing said receptacle including a contact-carrier member (4, 5, 6) composed of plastic material having a portion that is insertable into an opening (3) of the wall (2), and a plurality of contact elements (7) mounted on the contact-carrier member (4, 5, 6) so as to pierce the contact-carrier member transversely to the wall (2), wherein the improvement comprises:

a shielding plate (9) on said contact carrier element (4, 5, 6) for electrical connection to the wall (2);

said shielding plate (9) being pierced by the contact elements (7);

a lead-through capacitor (11) associated separately with each contact element (7), each capacitor (11) being electrically connected to the shielding plate (9) and penetrated by the associated contact element (7);

the contact-carrier member (4, 5, 6) includes a bottom (4) with a flange (5), intended for support against the wall (2) of the housing, and a wall region (6) protruding from the bottom (4) substantially at a right angle;

the shielding plate is disposed in the region of the bottom (4); and the contact elements (7) comprise contact pins that are parallel to the wall region (6) and penetrate the bottom (4).

10. A plug receptacle device in accordance with claim 9, wherein:

the wall region (6) and the bottom (4) of the contact-carrier member form a cup;

the flange (5) protrudes radially outward from the region of the bottom (4); and the shielding plate (9) protrudes outward beyond the wall region (6) and forms a contact region (12) adjacent the bearing surface of the flange which engages the wall (2) of the housing.

11. A plug receptacle device in accordance with claim 10, wherein:

the wall region (6) is generally annular-cylindrical in cross section;

the flange (5) is generally square in cross sectional contour, the length of a side thereof is substantially equal to the outside diameter of the wall region (6); and the shielding plate (9) is generally square in cross sectional contour corresponding approximately to the contour of the flange (5), the corner regions (12) of said plate (9) forming the contact region.

* * * * *

UNITED STATES PATENT AND TRADEMARK OFFICE

CERTIFICATE OF CORRECTION

PATENT NO. : 5,417,591

DATED : May 23, 1995

INVENTOR(S) : Holger Demmler

It is certified that error appears in the above-indentified patent and that said Letters Patent is hereby corrected as shown below:

Title Page, Item 75, "Bundesrepublik Deutschland" should read --Wonfurt--;
Col. 6, line 15, "Opening" should read --opening--;
Col. 6, line 17, "5,6)" should read --(4, 5, 6)--;
Col. 6, line 46, "housing said" should read --housing, said--;
Col. 7, line 4, delete "device";
Col. 8, line 1, delete "device".

Signed and Sealed this

Nineteenth Day of September, 1995

*Attest:*

Bruce Lehman

BRUCE LEHMAN

*Attesting Officer*

*Commissioner of Patents and Trademarks*